United States Patent [19]

Simons et al.

[11] Patent Number: 4,643,051

[45] Date of Patent: Feb. 17, 1987

[54] PACK CARBURIZING PROCESS FOR EARTH BORING DRILL BITS

[75] Inventors: Robert W. Simons, Pasadena; Danny E. Scott; John R. Poland, both of Houston, all of Tex.

[73] Assignee: Hughes Tool Company-USA, Houston, Tex.

[21] Appl. No.: 806,253

[22] Filed: Dec. 6, 1985

[51] Int. Cl.[4] ..... C21D 9/22

[52] U.S. Cl. ..... 76/108 A; 148/19

[58] Field of Search ..... 76/108 A, 108 R, 101 R, 76/DIG. 2; 148/15.5, 16.5, 19, 30

[56] References Cited

U.S. PATENT DOCUMENTS

| | | | |
|---|---|---|---|
| 539,089 | 5/1895 | Simonds | 148/131 |
| 1,561,482 | 11/1925 | Phillips | 148/19 |
| 2,048,526 | 7/1936 | Van der Pyl | 148/19 |
| 2,210,622 | 8/1940 | Kell | 148/30 |
| 4,188,242 | 2/1980 | Scales | 148/15.5 |

*Primary Examiner*—Roscoe V. Parker

*Attorney, Agent, or Firm*—Charles D. Gunter, Jr.

[57] ABSTRACT

A method of manufacturing an earth boring bit of the type having a bearing pin which extends from a head section of the drill bit for rotatably mounting a cutter. A container is provided having opposing end openings with sidewalls therebetween which define a container interior. The container is placed over a portion of the head section so that the pin extends within the interior of the container. A spring spacer is then installed within the interior of the container about at least a portion of the circumference of the bearing pin at at least one axial location. The container is then packed with a particulate treating medium, the container is covered, and the pin and container are placed into a furnace for a time and at a temperature sufficient to activate the treating medium.

5 Claims, 4 Drawing Figures

PACK CARBURIZING PROCESS FOR EARTH BORING DRILL BITS

BACKGROUND OF THE INVENTION

1. Field of the Invention

This invention relates in general to surface treatment of metals, and particularly to those for steels requiring wear resistance under heavy loads, such as those imposed upon earth boring drill bit bearings.

2. Description of the Prior Art

Various treatments are known in the prior art for the surfaces of metals, such as steel, which are used to provide hard, wear resistant surfaces upon the metals so treated. One prior art treatment technique is carburization.

The bearing surfaces of rotatable cutters in earth boring drill bits are commonly carburized, hardened and tempered to increase their wear resistance. Gas carburizing is a known technique which has been used in the past to produce a uniform case on the head section bearings of earth boring drill bits. Although gas carburizing provides good process control and a uniform resulting case, it can be a time consuming and expensive operation when a selectively applied case is required as on rock bit parts. Methods of selectively carburizing require masking of some areas with a coating to prevent carburization. Methods such as copper plating or using case preventive paints are used as masks for selective carburizing, but add cost to the processing.

Pack carburizing is another technique utilized in the manufacture of earth boring drill bits. A particulate carburizing compound is packed in a container which surrounds the drill bit bearing area which is to be treated. Selective carburization is accomplished by only surrounding the area needed with carburizing compound. The container and section of the bit head being treated are then placed into a furnace and heated at a temperature and for time sufficient to allow carburization.

One problem in obtaining a uniform case in pack carburizing is caused by low carbon potential furnace gases leaking into the container which surrounds the bearing area and holds the carburizing compound. Another problem which can result in poor carburization is shifting of the container and resulting loss of the compound due to handling or vibration in the furnace.

In order to prevent the infiltration of furnace gases into the carburizing container and movement of the container and loss of compound, Applicants tried various fixtures in an attempt to create a seal or affix the container to the bit head. These attempts included the use of wires which were fixed in the interior of the container and which radiated inward from the container internal diameter. Fixturing washers or rings were also used in an attempt to secure the container about the bit head. Each of these attempted solutions possessed certain disadvantages which made the attempted technique less than satisfactory.

SUMMARY OF THE INVENTION

The present invention is directed toward an improved method for pack carburizing the head section of earth boring drill bits. The method includes the use of an internal spacer, preferably a coil spring, which is installed within the interior of the carburizing container in the space between the head section to be treated and the container internal diameter. In another aspect of the invention, a finer carburizing compound, preferably in the size range from about 16 to 30 mesh or less is packed into the carburizing container and further assists in minimizing the infiltration of furnace gases into the container interior.

The finer carburizing compound packs easily through the spring retainer and eliminates the need for a two step packing process. Because of the resiliency of the coil spring, it conforms to variations in the container internal diameter and also does not scratch the surface of the head section being treated.

Additional objects, features and advantages will be apparent in the written description which follows.

DETAILED DESCRIPTION OF THE INVENTION

Figure 1:
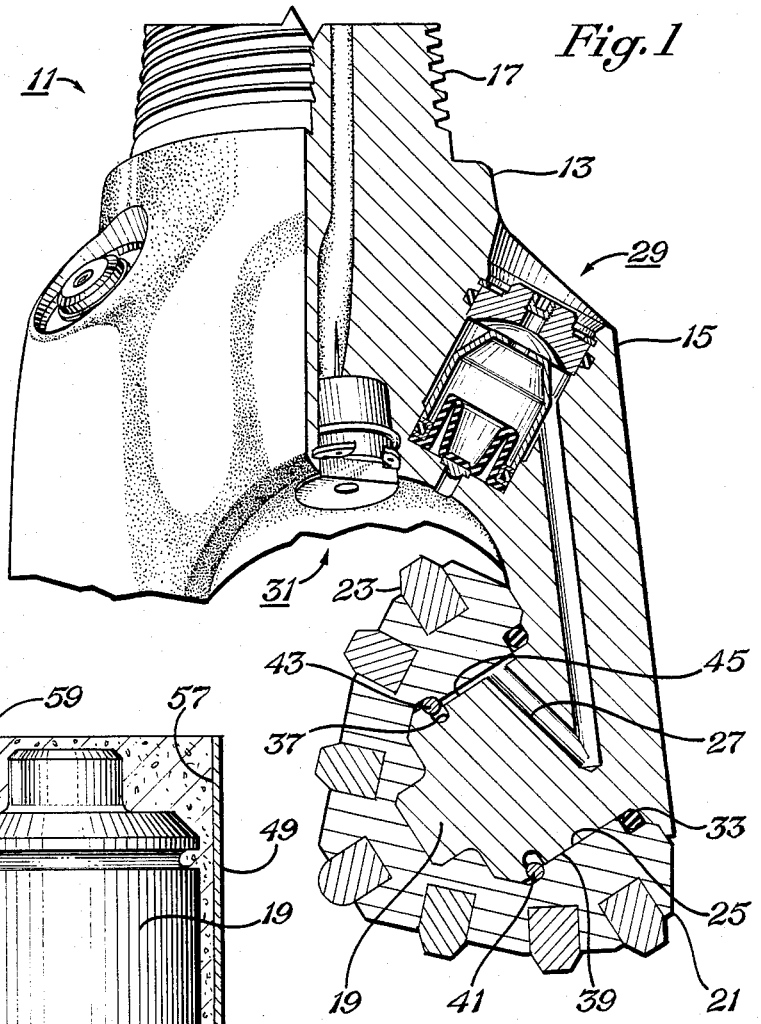
FIG. 1 is a side, perspective view of an earth boring drill bit which receives the treatment of the invention, partly in section and partly broken away.

Portions of an earth boring drill bit 11 are shown in FIG. 1, including a body 13 formed of three head sections 15 that are typically joined by a welding process. Threads 17 are formed on the top of the body 13 for connection to a conventional drill string, not shown. Each head section 15 has a cantilevered shaft or bearing pin 19 having its unsupported end oriented inward and downwardly. A generally conically shaped cutter 21 is rotatably mounted on each bearing pin 19. The cutter 21 has earth disintegrating teeth 23 on its exterior and a central opening or bearing recess 25 in its interior for mounting on the bearing pin 19. Friction bearing means formed on the bearing pin 19 and cutter bearing recess 25 are connected with lubricant passage 27. A pressure compensator 29 and associated passages constitute a lubricant reservoir that limits the pressure differential between the lubricant and the ambiant fluid which surrounds the bit after flowing through the nozzle means 31.

An O-ring seal 33 can be located between the bearing pin 29 and cutter 21 at the base of the bearing pin in a seal region. The O-ring 33 and seal region 35 at the base of the bearing pin 19 prevent egress of lubricant and ingress of borehole fluid.

An annular assembly groove 37 is formed on the cylindrical surface 39 of the bearing pin 19. A registering retainer groove 41 is formed in the bearing recess 25 of the cutter 21. Grooves 37 and 41 are appropriately located so that they register to define an irregularly shaped annular cavity in which is located a snap ring 43. The snap ring 43 preferably has a circular cross-section and is formed of a resilient metal. The ring 47 contains a gap at one circumferential location, so that its annular diameter may be compressed or expanded and also so that lubricant may flow past the ring.

Figure 2:
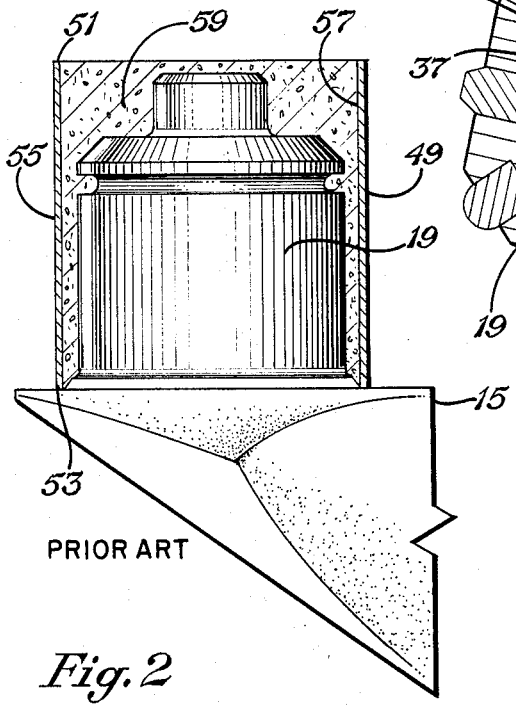
FIG. 2 is an isolated, schematic view of the pin of the bit of FIG. 1, showing the prior art treatment method.

FIG. 2 is a simplified schematic of the pin 19 which is surrounded by a generally cylindrical container 49 having opposing end openings 51, 53 with sidewalls 55 therebetween, thereby defining a container interior 57. Present heat treatments of the general bearing portion of the rock bit are carried out by carburizing and then boronizing the bearing pin. U.S. Pat. No. 4,188,242 teaches such a process for carburizing and then boronizing the bearing surface of a rotatable cutter in an earth boring drill bit. In the '242 patent, the metal bearing surface is first carburized and then boronized. The metal surface is then hardened in a manner to produce a martensitic grain structure in the carburized case, and tempered to produce tempered martensite with the result being a surface of extreme hardness.

FIG. 2 is intended to illustrate the prior art carburizing step in which a particulate, carburizing medium 59 is packed into the interior 57 of the container and surrounds the pin 19. The end opening 51 would then be covered by a lid and the head section 15 and pin 19 would be placed into a furnace for a time and at a temperature sufficient to allow carburization resulting in a carburized case on selected areas of the pin 19.

The present invention is the discovery that a more uniform case can be provided upon the pin 19 by stabilizing or securing the container 49 to the head section or pin 19. It has also been discovered that the use of a finer carburizing medium, together with a stabilizing spacer for the container, can further reduce furnace gas infiltration into the container interior 57 and thereby improve the quality of the metal treatment.

Although the present discussion is directed toward pack carburizing, it should be evident that the techniques discussed can be applied to any particulate treating medium, such as siliconizing, aluminizing (or calorizing), and other "pack" surface hardening techniques. Combinations of these treatments can also be used advantageously.

An expanded discussion of the pack carburizing technique can be found on pages 114–118 of volume 2 of the 8th Edition of the Metals Handbook, "Heat Treating, Cleaning and Finishing" (1964, American Society for Metals). An example of a pack carburizing treatment of a rock bit head section made of AISI 4815 steel is as follows:

Carburizing compound (packed around the surface to be carburized): charcoal (16 to 30 mesh or finer), energized with about 8–15% by weight of potassium carbonate. The carburizing temperature is typically around about 1700° F. and the carburizing time is typically about nine hours at 1700° F. The use of such a carburizing medium produces a carburized case depth of about 0.065 inches with carbon content at the surface of about 1.00%.

Figure 3:
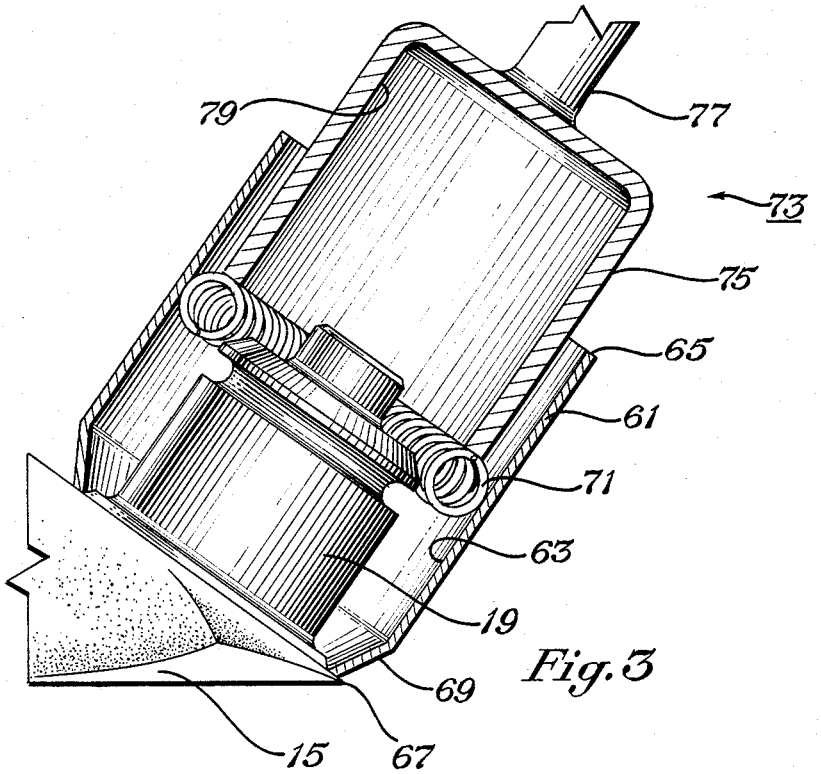
FIG. 3 is an isolated, schematic view, similar to FIG. 2, showing the container with the spring spacer of the invention being installed.

FIG. 3 shows a preferred method and apparatus for effecting the carburization of the bearing pin 19. A container 61 is first placed over a portion of the head section 15 so that the pin 19 extends within the interior 63 of the container. The container 61 can conveniently be a steel cylinder having end openings 65, 67. Open end 67 is placed over the pin 19 so that the head section functions as the container's bottom. The generally cylindrical sidewalls of the container 61 can taper inwardly at the end region 69 adjacent to the end opening 67.

A spacer means, such as spring spacer 71 is then installed within the interior 63 of the container 61 about at least a portion of the circumference of the bearing pin at one axial location. Preferably, the spring spacer 71 is a coil metal spring similar to the spring used upon a screen door. It is not necessary for the spring to extend 360° about the circumference of the pin 19 and more than one spring spacer can be utilized if desired. The action of the coil spring 71 and the tapered region 69 held by friction against the pin 19 force the container against the head section 15 to minimize intrusion of low potential furnace gas.

The spring spacer 71 is preferably installed within the interior of the container 61 with an installation tool (73 in FIG. 3). The installation tool 73 has a cup shaped end portion 75 and a handle 77. The cup shaped end portion 75 defines a cup interior 79 which is of sufficient diameter to receive the pin 19 when inserted within the container interior 63 so that the installation tool can be used to push the spring spacer 71 into the space which exists between the exterior of the pin 19 and the interior of the container 63 with the spring spacer 71 being seated against the tapered region 69.

Figure 4:
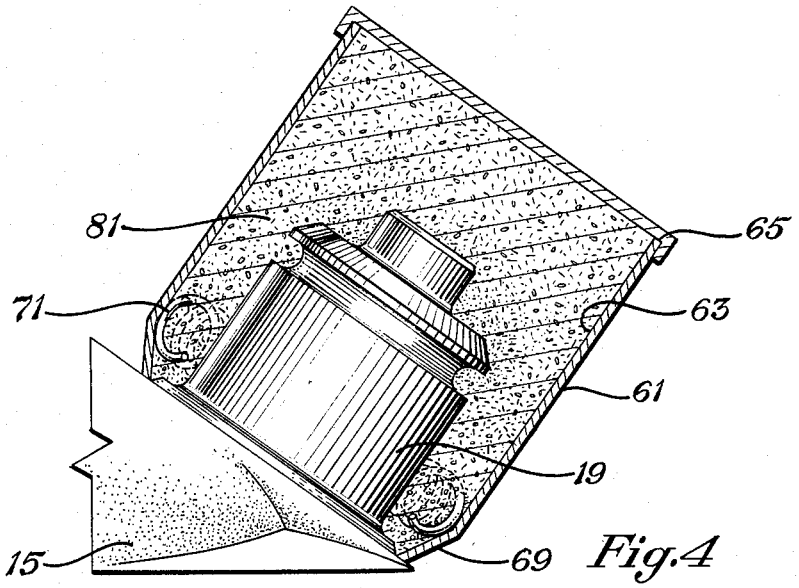
FIG. 4 is a view similar to FIG. 3 showing the spring spacer in position and showing the pack carburizing compound in place within the container and with the container lid in place.

The conainer 61 is then packed with the treating medium to be utilized and the container end opening 65 is covered with a suitable lid 62 which is used to seal off this end opening. It will be noted in FIG. 4 that the treating medium 81 is packed within the container interior 63 including the end region 69 containing the spring spacer 71. The pin and container are then placed into a furnace for a time and at a temperature to allow carburization and produce the desired characteristics in the surface metal of the pin.

An invention has been provided with several advantages. The spring spacer or retainer of the invention allows the particulate treating medium to be packed through the retainer, thereby eliminating the need for a two step packing process. The natural resiliency of the coiled spring prevents scratching of the metal surface being treated and conforms to variations encountered in the internal diameter of the surrounding container. The spring retainers are also readily available and inexpensive to obtain. The finer particle size of the treating medium produces a uniform case by exposing more surface area of the compound. The larger surface area of the compound, plus less area between particles helps to counter the effect of low carbon potential furnace gases leaking into the container. Compound loss is eliminated since movement of the container is eliminated.

While the invention has been shown in only one of its forms, it is not thus limited but is susceptible to various changes and modifications without departing from the spirit thereof.

We claim:

1. A method of manufacturing an earth boring drill bit of the type having a bearing pin extending from a head section of the drill bit for rotatably mounting a cutter, comprising the steps of:

providing a container having opposing end openings with sidewalls therebetween which define a container interior;

placing the container over a portion of the head section so that the pin extends within the interior of the container;

installing a spring spacer within the interior of the container about at least a portion of the circumference of the bearing pin at at least one axial location;

packing the container with a particulate treating medium;

covering the container; and placing the pin and container into a furnace for a time and at a temperature to activate the treating medium.

2. The method of claim 1, wherein the spring spacer is a coil spring.

3. A method of manufacturing an earth boring drill bit of the type having a bearing pin extending from a head section of the drill bit for rotatably mounting a cutter, comprising the steps of:

providing a container having opposing end openings with sidewalls therebetween which define a container interior;

placing the container over a portion of the head section so that the pin extends within the interior of the container;

installing a spring spacer within the interior of the container about at least a portion of the circumference of the bearing pin at at least one axial location;

packing the container with a particulate carburizing compound;

covering the container; and placing the pin and container into a furnace for a time and at a temperature to produce a pin having a carburized surface region.

4. The method of claim 3, wherein the paticulate carburizing compound is comprised of particles having a size smaller than about 16 to 30 mesh.

5. A method of manufacturing an earth boring drill bit of the type having a bearing pin extending from a head section of the drill bit for rotatably mounting a cutter, comprising the steps of:

providing a container having opposing end openings with sidewalls therebetween which define a container interior;

placing a container over a portion of the head section so that the pin extends within the interior of the container and so that a space exists between the exterior of the pin and the interior of the surrounding container;

installing a spring spacer within the interior of the container about at least a portion of the circumference of the bearing pin at at least one axial location with an installation tool, the installation tool having a cup shaped end portion which defines a cup interior, the cup interior being of sufficient diameter to receive the pin when inserted within the container interior so that the installation tool can be used to push the spring spacer into the space which exists between the exterior of the pin and the interior of the container;

packing the container with a particulate carburizing compound;

covering the container; and placing the pin and container into a furnace for a time and at a temperature to produce a pin having a carburized surface region.

* * * * *

UNITED STATES PATENT AND TRADEMARK OFFICE

CERTIFICATE OF CORRECTION

PATENT NO. : 4,643,051

DATED : February 17, 1987

INVENTOR(S) : Robert W. Simons, et al

It is certified that error appears in the above-identified patent and that said Letters Patent is hereby corrected as shown below:

In Col. 2, line 52, after "pin", delete "29" and insert --19--.

In Col. 2, line 53, after "region", delete "35".

In Col. 2, line 63, after "ring", delete "47" and insert --43--.

In Col. 4, line 19, change "conainer" to --container--.

In Col. 4, line 21, after "lid", delete "62".

Signed and Sealed this

Tenth Day of November, 1987

*Attest:*

DONALD J. QUIGG

*Attesting Officer*

*Commissioner of Patents and Trademarks*